US006402108B1

(12) United States Patent
Remmers

(10) Patent No.: US 6,402,108 B1
(45) Date of Patent: Jun. 11, 2002

(54) SHELVING BRACKET

(75) Inventor: Lee Remmers, Ocala, FL (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/436,364

(22) Filed: Nov. 9, 1999

(51) Int. Cl.[7] ..... A47G 29/02

(52) U.S. Cl. ..... 248/243; 211/90.03; 211/181.1; 211/187; 248/247; 248/250

(58) Field of Search ..... 248/247, 243–246, 248/250, 248, 249, 235, 241; 211/90.03, 181.1, 187; 108/105, 108, 143

(56) References Cited

U.S. PATENT DOCUMENTS

| | | | | | |
|---|---|---|---|---|---|
| 2,622,834 | A | | 12/1952 | Sparring | 248/243 |
| 2,681,786 | A | | 6/1954 | Sparring | 248/243 |
| 2,739,777 | A | | 3/1956 | Schoenhardt | 248/243 |
| 2,845,187 | A | | 7/1958 | Bianchi | 211/136 |
| 2,956,766 | A | | 10/1960 | Galassi | 248/243 |
| 3,082,880 | A | | 3/1963 | Mapson | 211/153 |
| 3,135,491 | A | | 6/1964 | Knape et al. | 248/243 |
| 3,167,037 | A | | 1/1965 | Mapson | 108/6 |
| 3,248,079 | A | | 4/1966 | Kennedy | 248/242 |
| 3,338,541 | A | | 8/1967 | Kellogg | 248/243 |
| 3,511,193 | A | | 5/1970 | Schild | 108/152 |
| 3,572,626 | A | | 3/1971 | Bertschi | 248/242 |
| 3,589,310 | A | | 6/1971 | Tucker | 108/108 |
| 3,765,344 | A | | 10/1973 | Ferdinand et al. | 108/108 |
| 4,189,123 | A | | 2/1980 | Johnson | 248/220.2 |
| 4,620,489 | A | | 11/1986 | Albano | 108/105 |
| 4,624,376 | A | * | 11/1986 | Bertram | 211/187 |
| D295,950 | S | | 5/1988 | Johnston | D8/381 |
| 5,154,388 | A | | 10/1992 | Magaro | 248/248 |
| 5,205,524 | A | | 4/1993 | Cohen | 248/235 |
| D341,819 | S | | 11/1993 | Carlstrom | D8/381 |
| 5,318,264 | A | | 6/1994 | Meiste | 248/221.4 |
| 5,346,077 | A | | 9/1994 | Randall | 211/90 |
| 5,592,886 | A | | 1/1997 | Williams et al. | 108/108 |
| 5,725,110 | A | | 3/1998 | Kluge et al. | 211/87.01 |
| 5,803,274 | A | | 9/1998 | Scheveloff | 211/87 |
| 5,921,412 | A | * | 7/1999 | Merl | 211/90.03 |
| 6,024,333 | A | * | 2/2000 | Raasch et al. | 248/247 |

* cited by examiner

*Primary Examiner*—Ramon O. Ramirez
*Assistant Examiner*—Tan Le
(74) *Attorney, Agent, or Firm*—Howrey Simon Arnold & White, LLP

(57) ABSTRACT

The present invention relates to a bracket for supporting either plank or wire shelving with the bracket mounted to a vertical support standard. The bracket contains a plurality of tabs, some of which extend in a downward direction and away from the main body of the bracket to form a series of notches. This tab and notch system allow the tabs to be inserted into the grooves in the vertical support standard which prevents dislocation of the bracket from the support standard. The bracket also contains an additional tab and notch to hold the rear of the longitudinal rod of a wire shelf in place. This tab may be bent forward to permanently lock the wire shelf into place. The bracket also, contains screw holes such that either plank or wire shelving can be mounted to it and has a front section that fits between the front longitudinal rods of a wire shelf to keep the wire shelf in place. Furthermore, the bracket contains raised surfaces on its sides that add a larger compression area such that the bracket can better support a load.

35 Claims, 6 Drawing Sheets

SHELVING BRACKET

BACKGROUND OF THE INVENTION

1. Field of the Invention

The present invention relates generally to the field of shelving brackets. More particularly, it concerns a double-sided bracket that attaches to a vertical support standard that may be used to support either wire or plank shelving.

2. Description of Related Art

Brackets for the purpose of supporting shelving are well known in the art. These brackets are often comprised of hooks or tabs that fit into grooves on vertical support standards and often differ in orientation, number and size. Improvements have been made in these types of brackets that have provided for greater load carrying capacity. However, additional improvements regarding the strength, load-bearing capacity and stability of these brackets remain warranted. There is also a need for a bracket having such characteristics that can support both plank and wire shelving.

It is therefore an object of this invention to provide a bracket which is able to support an increased load without shearing the bracket or causing the entire shelving unit to fall forward.

It is a further object of this invention to provide a bracket that will remain locked to the support standard when forced upward or downward pressure is placed on the front of the unit.

It is a further object of this invention to provide a bracket that supports both wire and plank shelving effectively and without additional parts, with the characteristics as described above.

Other objects of the invention will become apparent from the description and drawings.

SUMMARY OF THE INVENTION

The present invention relates to a bracket for supporting either plank or wire shelving that is able to be effectively attached to a traditional vertical support standard. Illustratively, the main body of the bracket may be single or double-sided with its sides having embossments or other outwardly protruding areas so as to increase its load-bearing capability by creating a larger compression area. The bracket may also have a top portion that is generally horizontal and can have an open or a closed configuration. Such top portion of the bracket also may contain screw holes so that it can effectively mount either plank shelving or wire shelving. If the bracket is constructed as a single-sided (or blade-type), it may also have a top portion such that the bracket, when viewed from the front or back, has an L shape.

The back or mounting side of the bracket contains a plurality of tabs, preferably three, such that the bracket can be attached to a traditional wall-mounted standard. Two of these tabs extend outwardly from the main body of the bracket and form notches between the tab and the body of the bracket. The notches formed by these tabs help prevent damage to the wall standard when the bracket is under extreme loading conditions because they are wider than the mounting area of a wall standard and allow a relatively large radius of motion. A middle one of these tabs may also form both a step at the top of the tab to prevent dislocation of the bracket when it is pushed straight up. A bottom notch at such middle tab also provides further load-bearing capacity to the bracket. The bracket may also have a lower tab which helps to keep the bracket in place when a load is placed on the top of the bracket, and to increase the load-bearing capacity of the bracket.

Located on the top, rear of the bracket is an additional tab and notch. The notch functions to hold the rear longitudinal rod of a wire shelf in place when attached to the bracket. If desired, the tab can be bent forward to lock in the rear longitudinal rod of a wire shelf. The bracket also contains a front section that provides support to the front longitudinal rods of a wire shelf, and can preferably fit between the front longitudinal rods of a wire shelf, so as to keep the wire shelf locked in place.

BRIEF DESCRIPTION OF THE DRAWINGS

The following drawings form part of the specification and are included to further demonstrate certain aspects of the present invention. The invention may be better understood by reference to one or more of these drawings in combination with the detailed description of specific embodiments presented herein.

DETAILED DESCRIPTION

Figure 1:
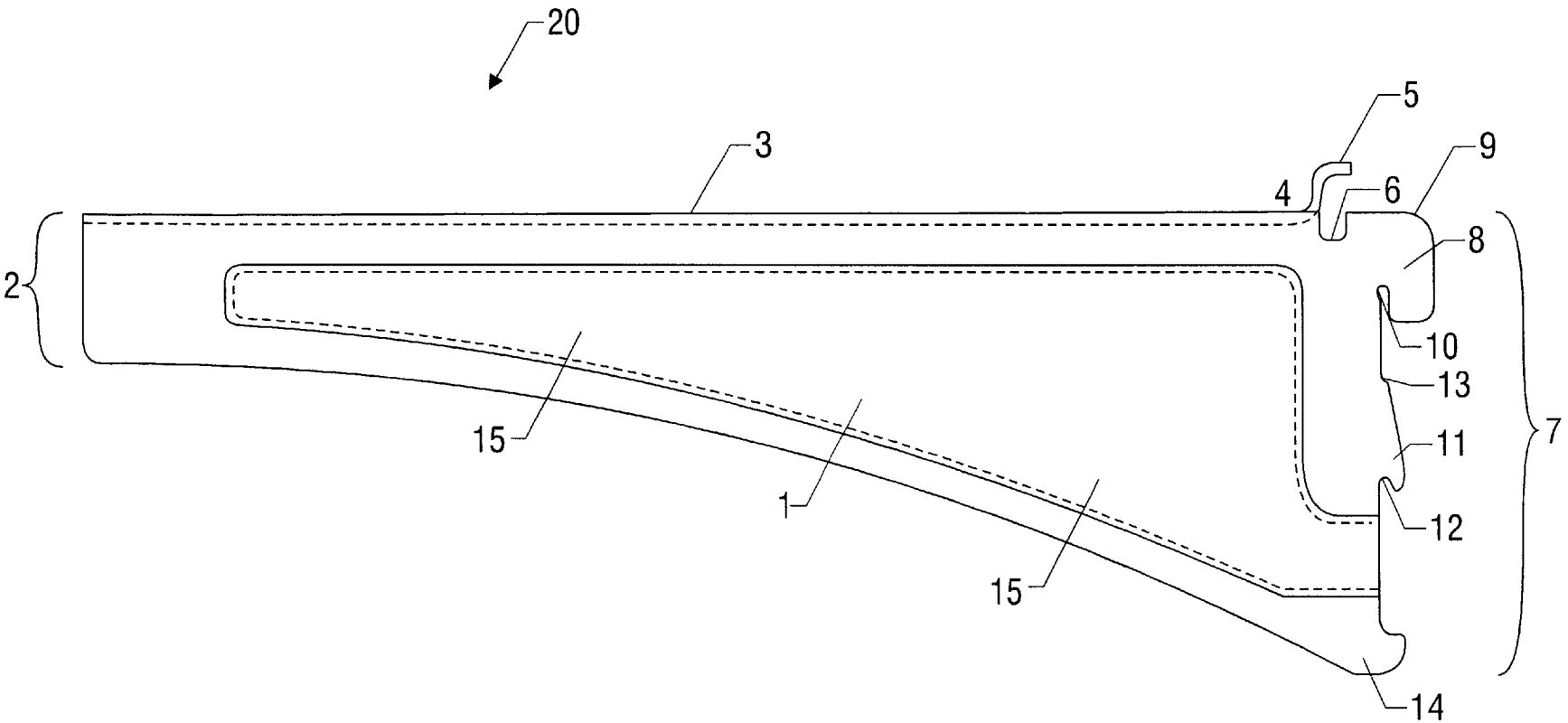
FIG. 1 is a side view of a one or two-sided embodiment of the bracket.
Figure 2:
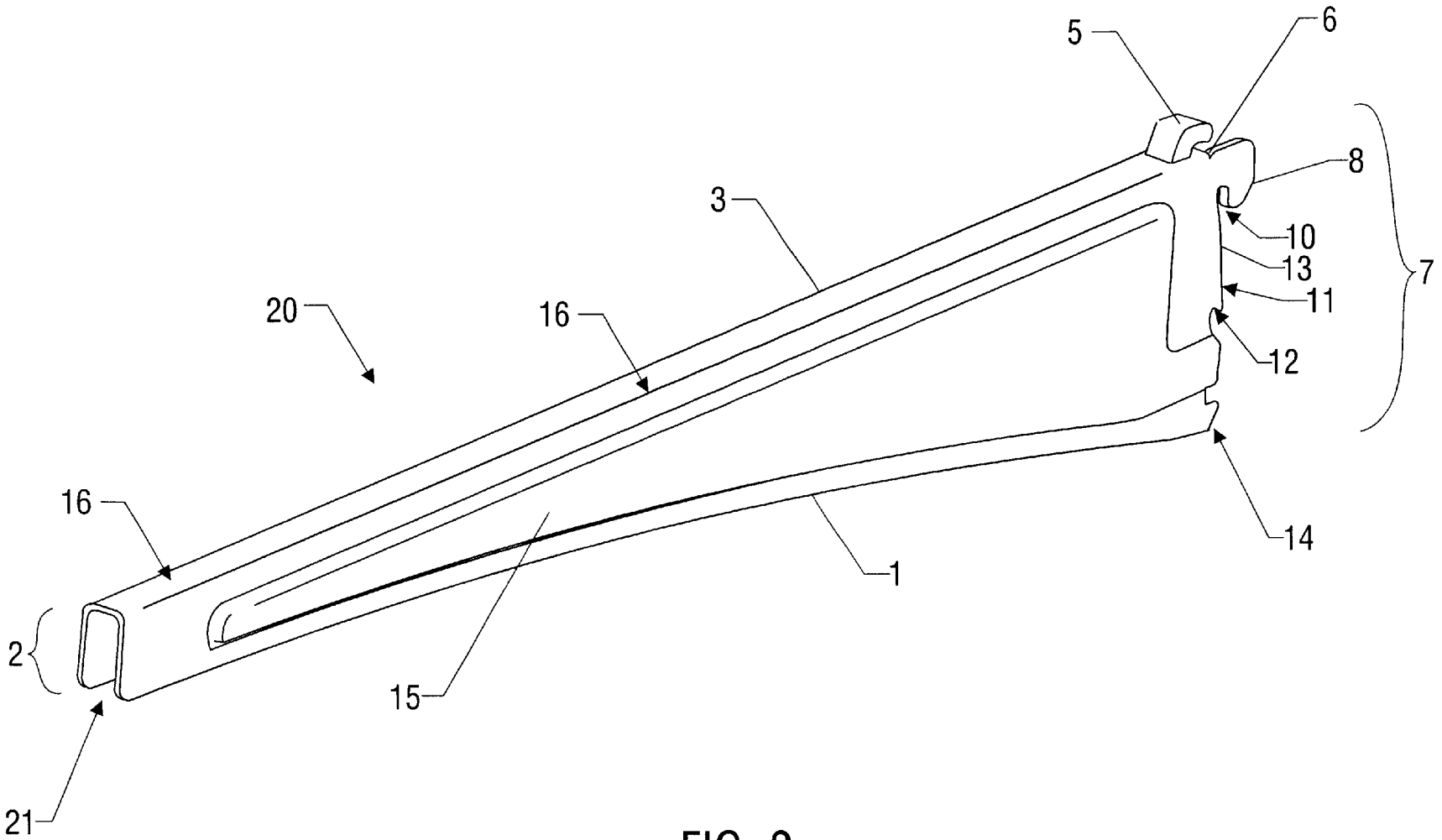
FIG. 2 shows a perspective view of a two-sided embodiment of the bracket having an open bottom.
Figure 4:
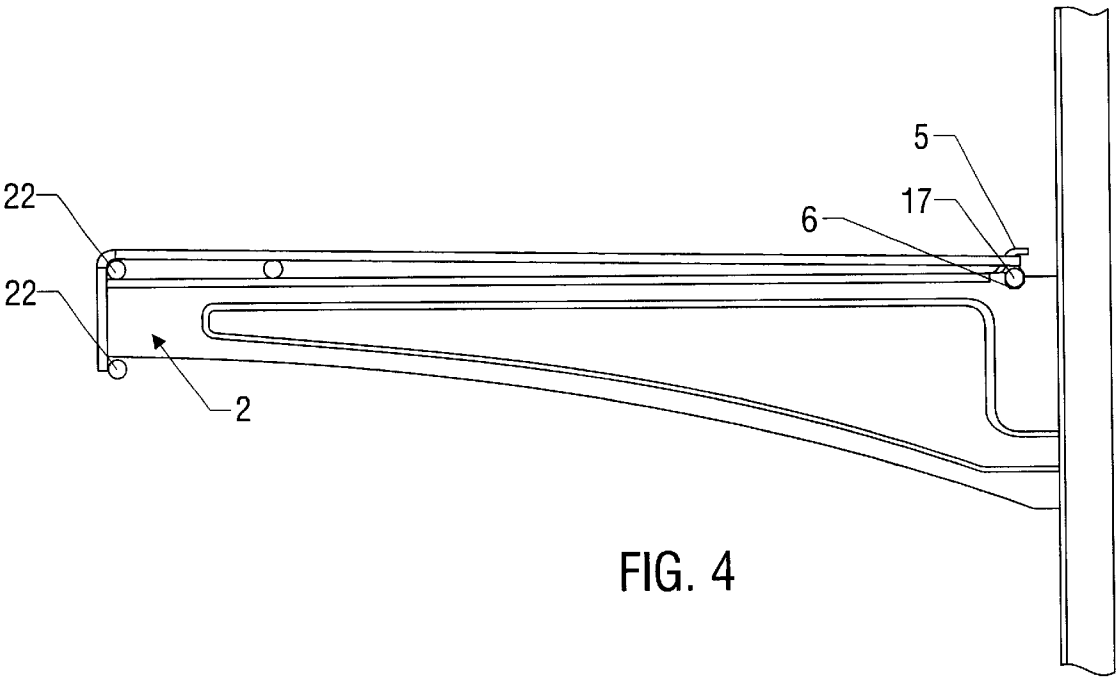
FIG. 4 is a side view of the bracket locked to a vertical support standard with a wire shelf attached.

As shown in FIGS. 1 and 2, bracket 20 comprises a bottom portion 1, which extends to a vertical front section 2. In an embodiment of the bracket having an additional side, as shown in FIG. 2, bottom portion I can have either an open or closed configuration. Front section 2 is generally perpendicular to both the front end of bottom portion 1 (which can be arched) and a generally horizontal top surface 3 and is preferably of a height such that when used with wire shelving, front section 2 is able to fit snugly between the front longitudinal rods of a wire shelf. This is shown in FIG. 4.

As reflected in FIGs. 1 and 2, near the rear of top surface 4 is tab 5 which is preferably located immediately in front of notch 6 but can also be located behind notch 6. Tab 5 works in conjunction with notch 6 to hold the rear longitudinal rod of a wire shelf in place such that it will not shift when a load is placed on the shelf. Tab 5 may also be bent down over notch 6 after a wire type shelf is installed to lock the rear longitudinal rod of a wire shelf into place, as shown in FIGS. 4 and 5.

Figure 5:
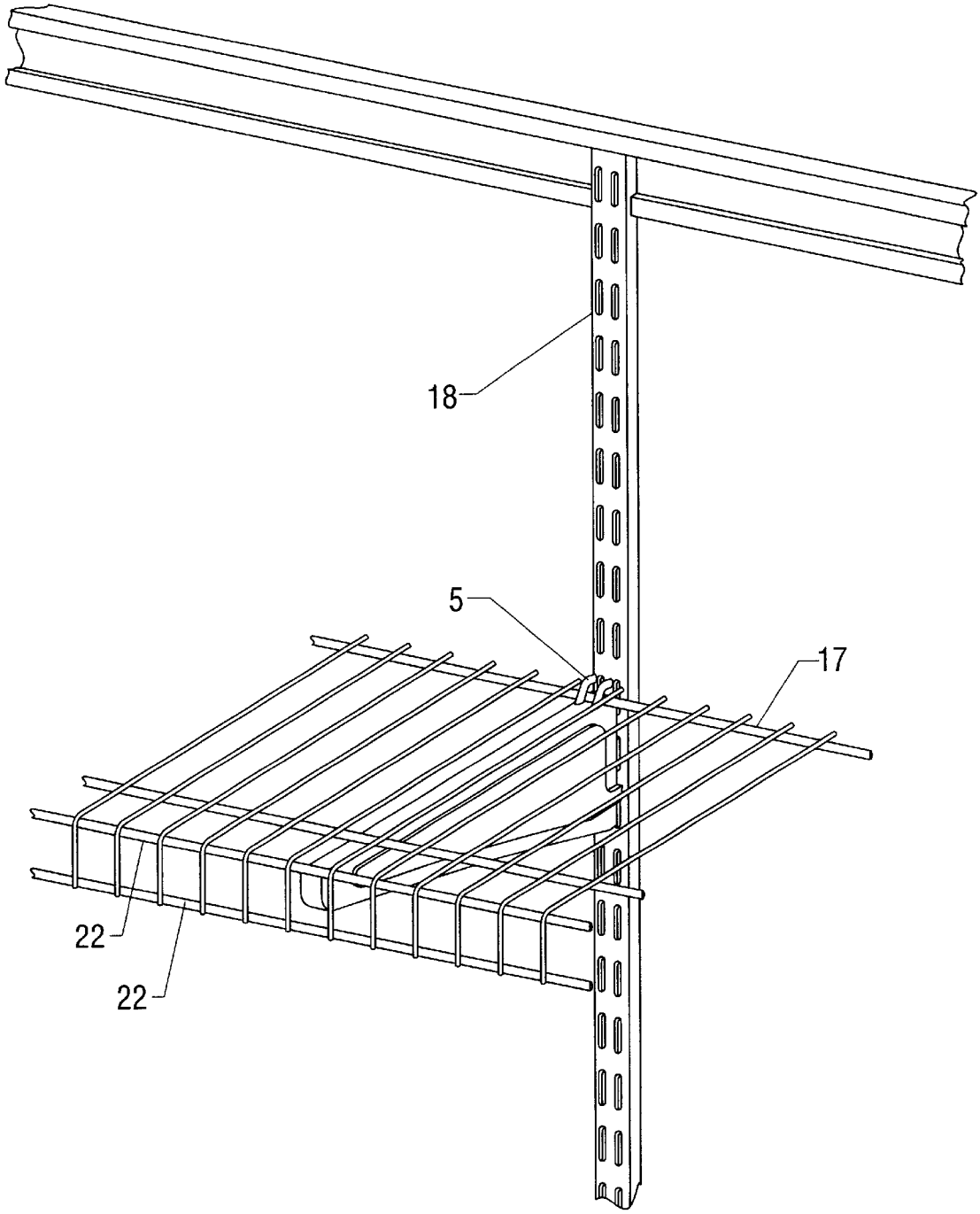
FIG. 5 is a perspective view of a two-sided embodiment of the bracket attached to a vertical standard wire shelf attached.

The bracket may be mounted to any ordinary wall standard (as shown in FIG. 5). The bracket can be mounted to such a wall standard by a series of tabs located on the back portion 7 of the bracket (as shown in FIG. 2). These tabs preferably comprise upper tab 8 which begins at the point where the back portion 7 of the bracket meets notch 6 and extends outwardly and then in a downward direction. Upper tab 8 then curves back toward back portion 7 of the bracket and upward, forming notch 10. Notch 10 may be wider than a mounting portion of the wall standard and may have a full radius to prevent tearing of the material when placed in a loaded condition, and to assist in installation of the bracket into the wall standard. A "mounting portion" of the wall standard is defined as that portion of the wall standard which fits into notch 10 to mount the bracket.

Located in the center of back portion 7 of the bracket is illustrated a middle tab 11, which extends downwardly in a diagonal direction from back portion 7. Middle tab 11 curves inwardly and upwardly, forming notch 12. Tab 11, in conjunction with notch 12 generally inhibits the front end of the bracket from being pushed up and becoming disjointed, and provides increased load-bearing capacity to bracket 20. Step 13, which slightly protrudes from back portion 7 at the top of notch 11, acts as a stop when the bracket is installed into the vertical standard by inhibiting the bracket from being dislocated when the bottom of back of the bracket is pushed in an upward direction.

In the illustrated exemplary embodiment, lower tab 14 is located at the back end of bottom surface 1. Lower tab 14 protrudes outwardly from a lower end of back portion 7, and is designed so as to further reinforce the load-bearing capacity of bracket 20, and to keep the bottom of the installed bracket locked in place when a load is placed on the bracket. Bracket 20 is mounted into the vertical wall standard by inserting tabs 8 and 11 into the grooves of the vertical standard using the full radius of motion allowed by notches 10 and 12, and then inserting tab 14 into the standard such that bracket 20 is in a stable position.

FIGS. 1 and 2 also show slightly protruding areas 15, preferably located on all sides of the bracket. Areas 15 add a larger compression area when the bracket is under a load, and can be embossments, as shown in FIGS. 1 & 2. As a result, bracket 20 will be able to accept heavier loading conditions.

Figure 3:
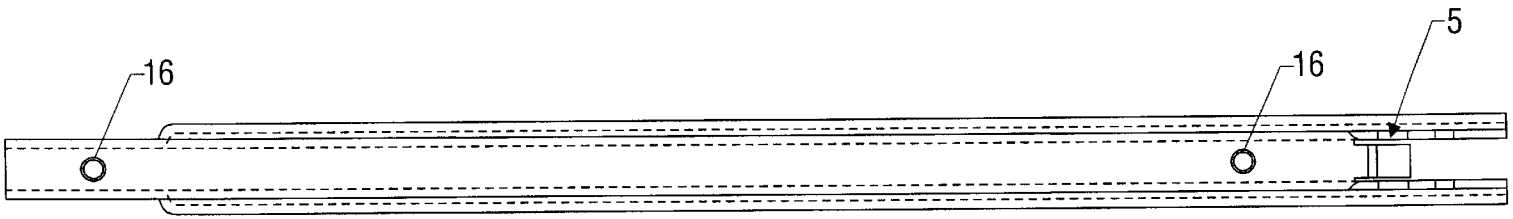
FIG. 3 is a top view of an embodiment of the bracket having a top portion.
Figures 6, 7:
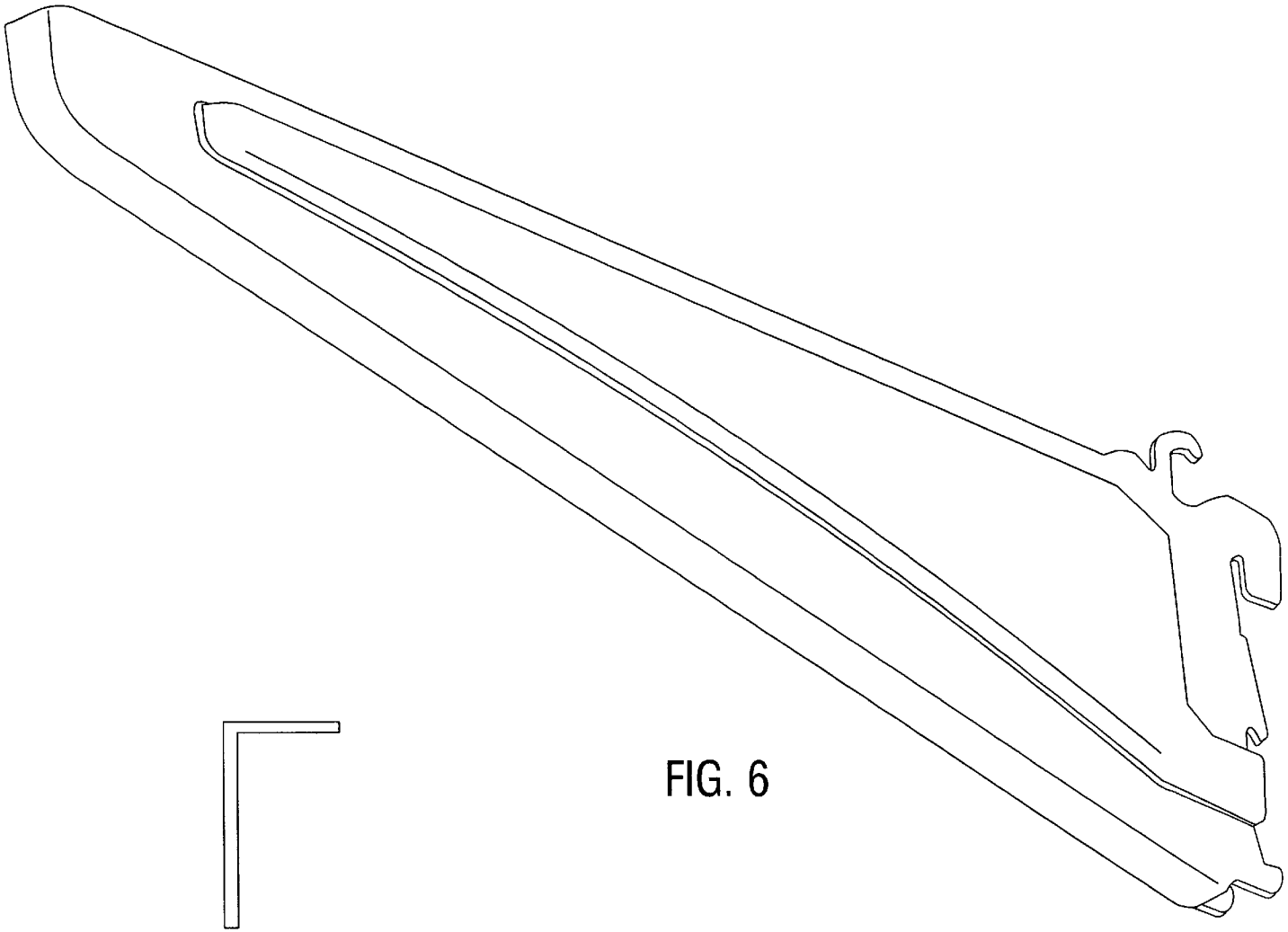
FIG. 6 is a perspective of an additional two-sided embodiment of the bracket having an open top.
FIG. 7 is a back view of a one-sided embodiment of the bracket having a top portion.
Figure 8:
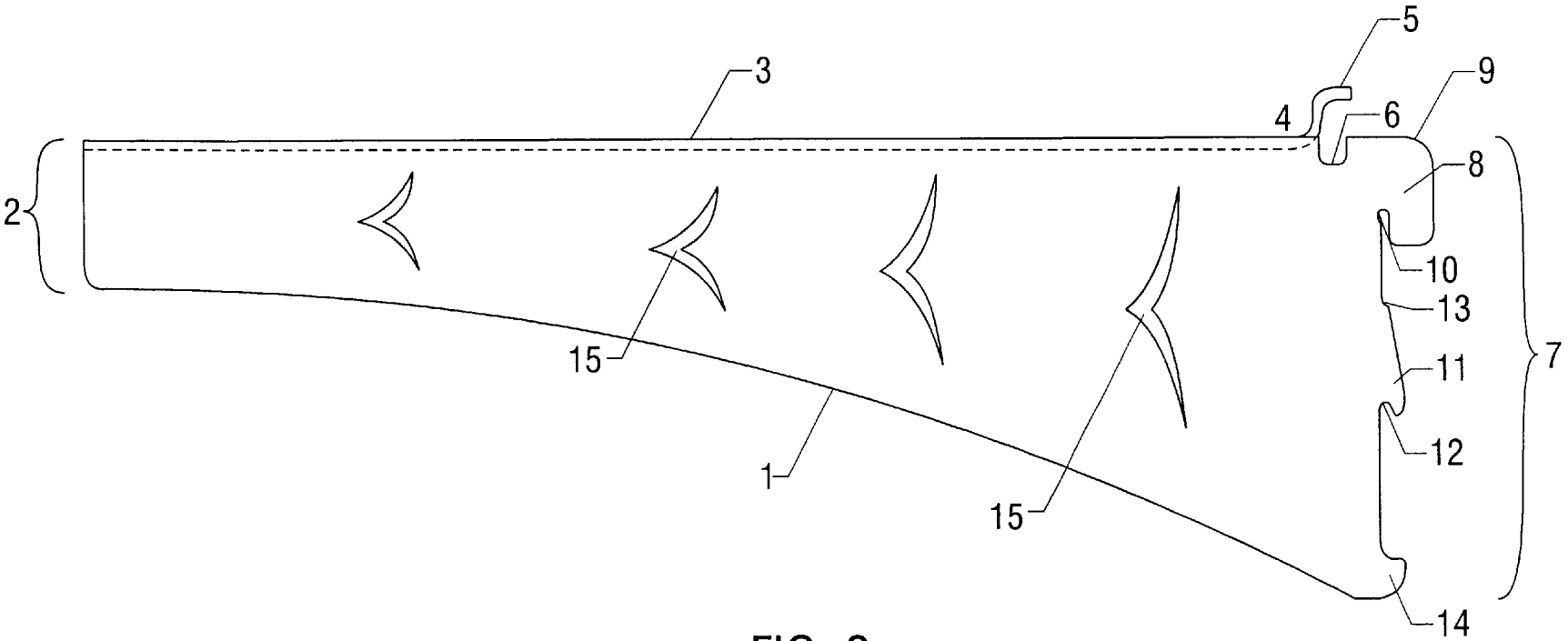
FIG. 8 is a side view of another one or two-sided embodiment of the bracket.

FIG. 2 also shows screw holes 16 for attaching plank style shelving to the bracket in lieu of wire shelving. Such a configuration can also be used with a single-sided bracket having a top potion, as shown in FIG. 7. FIG. 3, which is a top view of the bracket, illustrates the preferred location of screw holes 16, being approximately ½ inch inward from the far end of the bracket and approximately ½ inch inward from tab 5 in a 2-hole configuration. Any number or location of screw holes 16 can be used, however, that will effectively attach an embodiment of bracket 20 to plank shelving rather than wire shelving.

FIG. 4 and FIG. 5 illustrate the bracket as attached to a wall standard 18, and used with wire type shelving. FIG. 4 shows the longitudinal rod 17 of a wire shelf resting in notch 6 and secured by tab 5. Also shown is front section 2 as inserted between the front longitudinal rods 22 of the wire shelf. FIG. 5 shows a perspective view of the longitudinal rod of a wire shelf 17, resting in notch 6 and secured by tab 5. FIG. 5 also shows an alternate embodiment of front section 2 in which it supports the front longitudinal rods 22 of a wire shelf, but is not as wide as the distance between the rods and does not fit snugly between them.

FIG. 6 discloses an alternate embodiment of a two-sided version of bracket 20 having an open top and closed bottom. This embodiment is designed for use primarily with wire shelving, as it does not contain screw holes 16 for attachment to plank shelving.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

What is claimed is:

1. A shelving bracket for mounting to a wall standard, said bracket comprising:

a main body section, having front and back portions and a top portion, upper and middle tabs extending from the back portion of said main body section, each tab having a notch between the main body section and the tab, such notches being wider than the width of a mounting portion of the wall standard, and said middle tab defining a step portion at the top of said tab;

a bottom tab extending generally horizontally from the bottom of the back portion of the main body section; and an upper notch able to receive a shelving wire located on a top rear portion of the main body section of the bracket, and a tab adjacent to said notch able to be bent down over said notch to lock said wire shelf in place.

2. A shelving bracket according to claim 1 wherein at least one of the notches is wider than the width of a mounting portion of the wall standard.

3. A shelving bracket according to claim 1 wherein the main body section defines an additional side.

4. A shelving bracket according to claim 1 further comprising a plurality of screw holes in said top portion of said bracket.

5. A shelving bracket according to claim 1 further comprising one or more raised surfaces on one or more sides of the main body section portion.

6. A shelving bracket according to claim 5 wherein said raised surfaces are embossments.

7. A shelving bracket according to claim 1 wherein said middle tab defines a step at the top of said tab.

8. A shelving bracket for mounting to a wall standard, said bracket comprising:

a main body section, having back and front portions;

at least one upper tab extending from the back portion of said main body section, the upper tab defining an open area between the main body section of the bracket and the tab;

a bottom tab located at a bottom of the back portion of the main body section that protrudes in a direction opposite the front portion of the main body section; and a notch able to receive a shelving wire located on a top portion of the main body section of the bracket, and a means to cover said notch.

9. A shelving bracket according to claim 8 wherein said means to cover said notch is a tab that is able to be bent down over said upper notch.

10. A shelving bracket according to claim 8 further comprising one or more raised surfaces on one or more sides of the main body section portion.

11. A shelving bracket according to claim 10 wherein said raised surfaces are embossments.

12. A shelving bracket according to claim 8 said main body section defining a top portion.

13. A shelving bracket according to claim 12 wherein the main body section defines an additional side.

14. A shelving bracket according to claim 12 further comprising a plurality of screw holes in said top portion of said bracket.

15. Shelving bracket according to claim 8 wherein said main body section defines a bottom portion.

16. A shelving bracket according to claim 15 wherein the main body section defines an additional side.

17. A shelving bracket according to claim 8 wherein at least one of the open areas is wider than the width of a mounting portion of the wall standard.

18. A shelving bracket according to claim 8 wherein said front portion of the main body section fits between front longitudinal wires of a wire shelf.

19. A shelving bracket according to claim 8 wherein said upper tab defines a step at the top of said tab.

20. A unit for storing clothes in a closet, comprising:

a wall standard defining a plurality of slots;

a shelf; and a shelving bracket able to be mounted to said wall standard to hold said shelf, comprising a main body section having back and front portions; at least one upper tab extending from the back portion of said main body section, the upper tab defining an open area between said main body section of the bracket and the tab; a bottom tab that is configured to be inserted into a slot on the wall standard and is located at a bottom of the back portion of the main body section; and a notch able to receive a shelving wire located on a top portion of the main body section of the bracket, and a means to cover said notch.

21. A shelving bracket according to claim 20 wherein at least one of the open areas is wider than the width of a mounting portion of the wall standard.

22. A shelving bracket according to claim 20 wherein said means to cover said notch is a tab that is able to be bent down over said notch.

23. A shelving bracket according to claim 20 further comprising one or more raised surfaces on one or more sides of the main body section portion.

24. A shelving bracket according to claim 20 wherein said raised surface are embossments.

25. A shelving bracket according to claim 20 wherein said main body section defines a top portion.

26. A shelving bracket according to claim 25 wherein the main body section defines an additional side.

27. A shelving bracket according to claim 25 further comprising a plurality of screw holes in said top portion of said bracket.

28. A shelving bracket according to claim 20 wherein said main body section defines a bottom portion.

29. A shelving bracket according to claim 28 wherein the main body section defines an additional side.

30. A shelving bracket according to claim 20 wherein said front portion of the main body, section fits between front longitudinal wires of a wire shelf.

31. A shelving bracket according to claim 20 wherein one or more of said upper tabs define a step at the top of said tab.

32. The unit of claim 20 wherein said shelf is a plank-type shelf.

33. The unit of claim 20 wherein said shelf is a wire-type shelf.

34. A shelving bracket for mounting to a wall standard, said bracket comprising:

a main body section, having back and front portions;

at least one upper tab extending from the back portion of said main body section, the upper tab defining an open area between the main body section of the bracket and the tab;

a bottom tab located at a bottom of the back portion of the main body section; and a notch able to receive a shelving wire located on a top portion of the main body section of the bracket, and a tab that is able to be bent down over said notch.

35. A unit for storing clothes in a closet, comprising:

a wall standard defining a plurality of slots;

a shelf; and a shelving bracket able to be mounted to said wall standard to hold said shelf, comprising a main body section having back and front portions; at least one upper tab extending from the back portion of said main body section, the upper tab defining an open area between said main body section of the bracket and the tab; a bottom tab located at a bottom of the back portion of the main body section; and a notch able to receive a shelving wire located on a top portion of the main body section of the bracket, and a tab that is able to be bent down over said notch.

* * * * *